US005762241A

United States Patent [19]

Cross

[11] Patent Number: 5,762,241

[45] Date of Patent: Jun. 9, 1998

[54] WATCHBAND

[75] Inventor: Gregory L. Cross, Arvada, Colo.

[73] Assignee: Sun Company, Inc., Arvada, Colo.

[21] Appl. No.: 790,120

[22] Filed: Jan. 29, 1997

[51] Int. Cl.[6] ..... A44C 5/00

[52] U.S. Cl. ..... 224/173; 224/178; 224/901.4

[58] Field of Search ..... 224/173, 178, 224/164, 219, 222, 267, 901.4; 63/3

[56] References Cited

U.S. PATENT DOCUMENTS

| | | | |
|---|---|---|---|
| 2,796,747 | 6/1957 | Ebert | 224/173 X |
| 3,543,977 | 12/1970 | Lockridge . | |
| 3,668,890 | 6/1972 | Broido | 63/3 |
| 3,747,171 | 7/1973 | Montague, Jr. | 224/901.4 |
| 4,047,651 | 9/1977 | McMullen . | |
| 4,103,808 | 8/1978 | Hallman et al. . | |
| 4,213,548 | 7/1980 | Wood . | |
| 4,591,836 | 5/1986 | Feigenblatt, Jr. et al. . | |
| 4,645,102 | 2/1987 | Proellochs | 224/178 |
| 4,916,679 | 4/1990 | Agnello . | |
| 5,214,874 | 6/1993 | Faulkner . | |

*Primary Examiner*—Renee S. Luebke

*Attorney, Agent, or Firm*—Dorr, Carson, Sloan & Birney, P.C.

[57] ABSTRACT

A watchband has a flexible outer band with hook-and-loop fasteners (e.g., Velcro) on its inner surface, and a flexible inner band with complementary hook-and-loop fasteners on its outer surface. The fasteners on the inner band removably engage the fasteners on the outer band to fasten the watchband about the wearer's wrist. The outer band includes an outer layer of decorative material, a layer of hook-and-loop fastener material on its inner surface covered by the decorative material, and a thin flexible plastic strip coated with adhesive that bonds the decorative material to the fastener material. This construction permits the outer band to be easily trimmed to a desired length to form a continuous band around the wearer's wrist with the ends of the outer band abutting each other. Similarly, the inner band can be easily trimmed to a desired length so that the outer band substantially conceals the inner band when fastened around the wearer's wrist.

19 Claims, 3 Drawing Sheets

Fig. 3
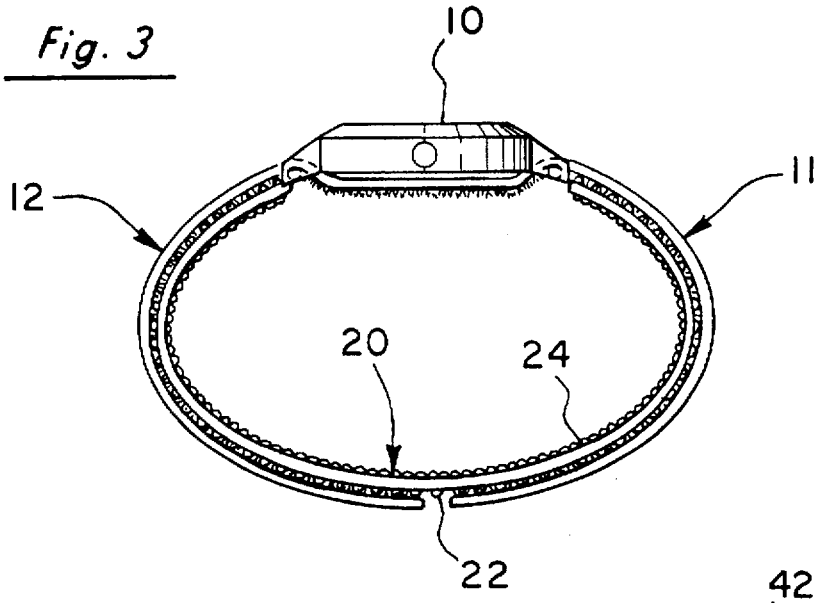
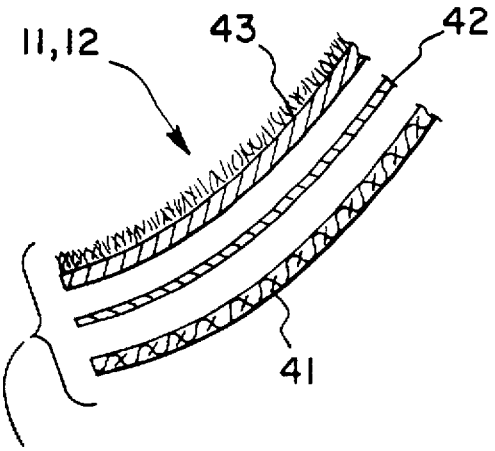
Fig. 4
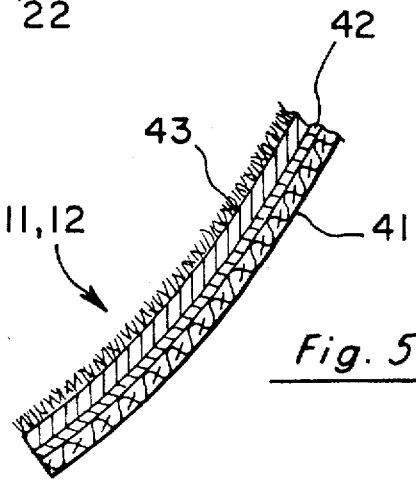
Fig. 5
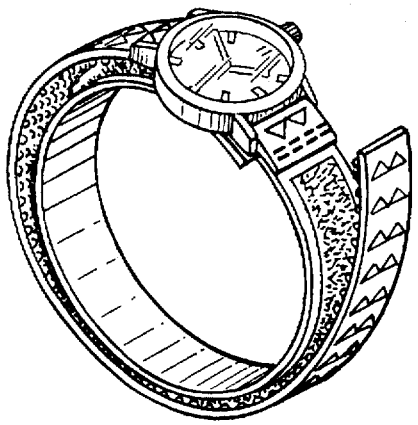
Fig. 6
(Prior Art)

WATCHBAND

BACKGROUND OF THE INVENTION

1. Field of the Invention.

The present invention relates generally to the field of watchbands. More specifically, the present invention discloses a watchband having a flexible outer band with two opposing ends with hook-and-loop fasteners on their inner surfaces, and a separate flexible inner band with hook-and-loop fasteners on its outer surface that engage the fasteners on the inside surface of the outer band to fasten the watchband about the wearer's wrist.

2. Statement of the Problem.

VELCRO watchbands have long been widely used for many years. One type of prior art watchband is a strip of cloth with hook fasteners on a portion of the underside and loop fasteners on a portion of the upper surface of the cloth. The watchband is simply wound around the wrist until the hooks engage the loop fasteners on the upper surface of the cloth. Watchbands of this general type are marketed under the names "EK" and "THE BAND", as shown in FIGS. 6 and 7. These watchbands are difficult to put on and take off, and the watch tends to protrude from the wrist since there are two layers of the watchband under the watch. For rock climbing, etc., a lower profile is preferred for the watch. The hook-and-loop fasteners extend nearly all the way around the wearer's wrist to maximize strength. Consequently, this type of watchband is hard to put on and take off because the inner portion (loop) portion must be wrapped nearly 360 degrees around the wrist, and then the outer portion (hook) must again be wrapped nearly 360 degrees around the wrist while maintaining alignment between the hook-and-loop fasteners. Another problem is that these prior art watchbands are relatively uncomfortable since the material in contact with the skin is either tightly-woven nylon or propylene webbing. Finally, the prior art watchbands are unnecessarily expensive because much overlapping material is used and the decorative outer band is sewn to the inner band of fastener material. This construction prevents a variety of decorative outer bands from being used interchangeably con a common inner band, as they can be used in the present invention.

Other prior art in the general field includes the following:

| Inventor | Patent No. | Issue Date |
|---|---|---|
| Lockridge | 3,543,977 | Dec. 1, 1970 |
| Montague | 3,747,171 | July 24, 1973 |
| Hallman et al. | 4,103,808 | Aug. 1, 1978 |
| McMullen | 4,047,651 | Sep. 13, 1977 |
| Wood | 4,213,548 | July 22, 1980 |
| Feigenblatt et al. | 4,591,836 | May 27, 1986 |
| Agnello | 4,916,679 | Apr. 10, 1990 |
| Faulkner | 5,214,874 | June 1, 1993 |

Hallman et al. disclose a watchband having a Y-shaped end with two VELCRO patches 18 and 24. The other end of the watchband has a VELCRO patch 30 that engages the opposing VELCRO patch 18 to secure the watchband around the wearer's wrist. The upper branch of the Y is a lock flap 14 that can be folded over the watch as shown by the dotted lines 48 in FIG. 1 to protect the watch. The flap 14 can also be folded back as shown in FIG. 2 to expose the watch face.

Lockridge and Faulkner disclose essentially the same device, but with two different purposes. Lockridge's device is used to strap reference material (e.g., maps or charts) to the leg of a pilot. Faulkner uses the same device to strap a lure or hook to the hand grip of a fishing rod as shown in FIG. 6.

Montague, Wood, and McMullen disclose examples of VELCRO watchbands with complementary VELCRO patches on the ends of the watchband.

Feigenblatt et al. disclose a panic alarm wrist watch. VELCRO strips 26 and 283 are used to fasten the watchband around the wearer's wrist.

Agnello discloses a sports watch protector having a band made of elastomeric material that partially covers the watch face under normal conditions, but can be manually stretched to uncover the watch face.

3. Solution to the Problem. None of the prior art references uncovered in the search show a watchband that has a flexible outer band with hook-and-loop fasteners (e.g., VELCRO) on its inner surface, and a separate, flexible inner band with complementary hook-and-loop fasteners on its outer surface. The fasteners on the inner band removably engage the fasteners on the inside surface of the outer band to fasten the watchband about the wearer's wrist.

This design offers a number of substantial advantages over the prior art. The outer band can be easily removed. Therefore, outer bands can be sold separately and used interchangeably for decorative variety. The present configuration results in a lower profile since only one band (i.e., the outer band) passes under the watch, in contrast to two layers "THE BAND", etc. The outer band can be manufactured in one oversize length that can be easily cut to fit a wide range of wrist sizes. The watchband can also be trimmed so that it can be worn over or under a shirt sleeve, sweater, jacket, etc.

The present watchband is also much easier to put on and take off the wearer's wrist. As previously mentioned, "THE BAND" requires nearly two full revolutions around the wrist to attach or remove the watchband. In contrast, the wearer must only pull the outer band in the present design roughly a third of a revolution to release the band from the wrist.

SUMMARY OF THE INVENTION

This invention provides a watchband having a flexible outer band with hook-and-loop fasteners (e.g., VELCRO) on its inner surface, land a flexible inner band with complementary hook-and-loop fasteners on its outer surface. The fasteners on the inner band removably engage the fasteners on the outer band to fasten the watchband about the wearer's wrist. The outer band includes an outer layer of decorative material that is sewn or otherwise attached to a layer of hook-and-loop fastener material on its inner surface, and a thin flexible plastic strip coated on both sides with adhesive that bonds the decorative material to the fastener material. This construction permits the outer band to be easily trimmed to a desired length without unraveling due to the adhesive strip. When worn around the wearer's wrist, the outer band forms a continuous band with its ends abutting each other. The inner band can also be easily trimmed to a desired length so that the outer band substantially conceals the inner band when fastened around the wearer's wrist.

A primary object of the present invention is to provide a casual watchband that is attractive and inexpensive, particularly since the decorative outer band is interchangeable and can be sold separately from the inner band.

Another object of the present invention is to provide a watchband that can be easily trimmed to fit the wearer's wrist, or can be worn under or over a layer of clothing.

Another object of the present invention is to provide a watchband that can be used with virtually any type of watch.

Yet another object of the present invention is provide a watchband that is well-suited for active wear, in that it does not have buckles or other protruding parts and is securely fixed in place with hook-and-loop fasteners around nearly its entire circumference.

Another object of the present invention is to provide a watchband that is made of tough synthetic material and yet is comfortable, due to its nylon pile construction on the inner surface. This high, loose-woven pile wicks moisture from the skin, increases surface area, and so speeds the evaporation of perspiration.

Yet another object of the present invention is to provide a watchband that can easily, have outdoor accessories (e.g., a wrist compass or thermometer) attached to either side of the watch without removing the watchband from the wrist.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 3 is a side view of the watchband assembly and watch with the inner and outer bands of the watchband fastened together.

FIG. 4 is an exploded side view of a portion of the outer band.

FIG. 5 is a cross-sectional view of the outer band.

FIG. 6 is a front perspective view of a prior art watchband marketed by Chisco under the name "The Band".

DETAILED DESCRIPTION OF THE INVENTION

Figure 1:
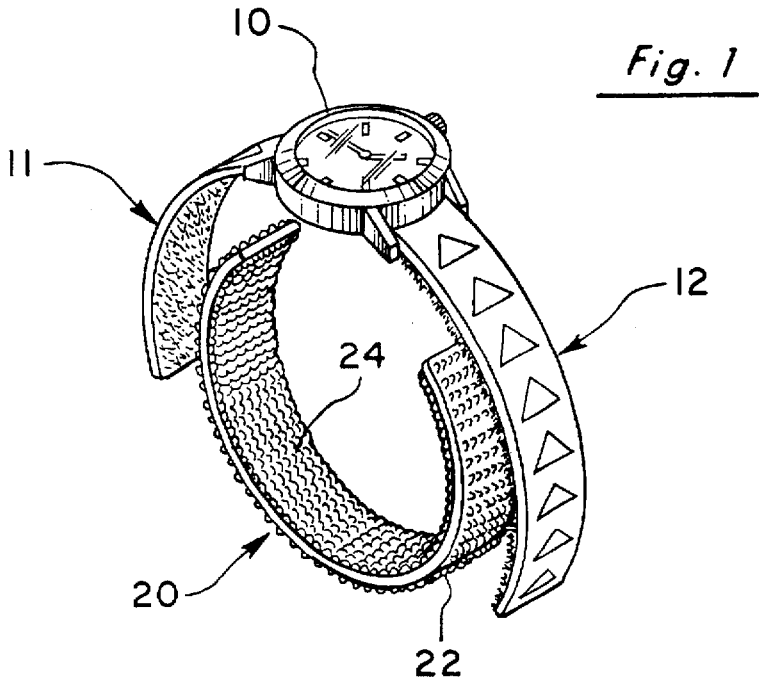
FIG. 1 is an exploded front perspective view of the watchband assembly and the watch.

Turning to FIG. 1, an exploded front perspective view is provided of the watchband assembly. The major components of the assembly are the outer band 11, 12 and the inner band 20.

The outer band 11, 12 may be one continuous flexible piece as illustrated in FIG. 1, or two separate pieces extending from either side of the watch 10. In the preferred embodiment of the present invention, the outer band 11, 12 has several layers that are bonded or sewn together. FIG. 4 is an exploded side view of a portion of the outer band 11, 12 and FIG. 5 is a cross-sectional view of the assembled outer band 11, 12. An outer decorative layer 41 made of decorative woven or printed ribbon or embroidered cloth forms the outer surface of the outer band 11, 12. Hook-and-loop fasteners 43 substantially cover the inner surface of the outer band 11, 12. For example, these fasteners are commercially available in the form of VELCRO fasteners bonded to a cloth backing. The VELCRO material 43 can be sewn, heat-bonded, or fastened by adhesive to the decorative layer 41 along the edges of the watchband. The decorative layer 41 completely covers and conceals the VELCRO material 43 when the watchband is worn, and thereby maintains an aesthetic outward appearance.

In the preferred embodiment, a thin flexible plastic strip (e.g., polyester) 42 is sandwiched between the VELCRO material 43 and the outer decorative material 41. Both sides of the plastic strip 42 are coated with a permanent adhesive to bond the decorative material 41 to the VELCRO layer 43. At least one end 11 of the outer band can be easily trimmed with scissors or a knife to a desired length. Normally, the outer band would b,e cut to a length so that its ends 11 and 12 abut one another when the band is wrapped around the wearer's wrist. The adhesive coating helps to prevent the outer band from fraying or delaminating after it has been cut. It also adds strength to the watchband, making the outer band more durable than prior art watchbands, such as "THE BAND" or "EK" watchbands.

Figure 2:
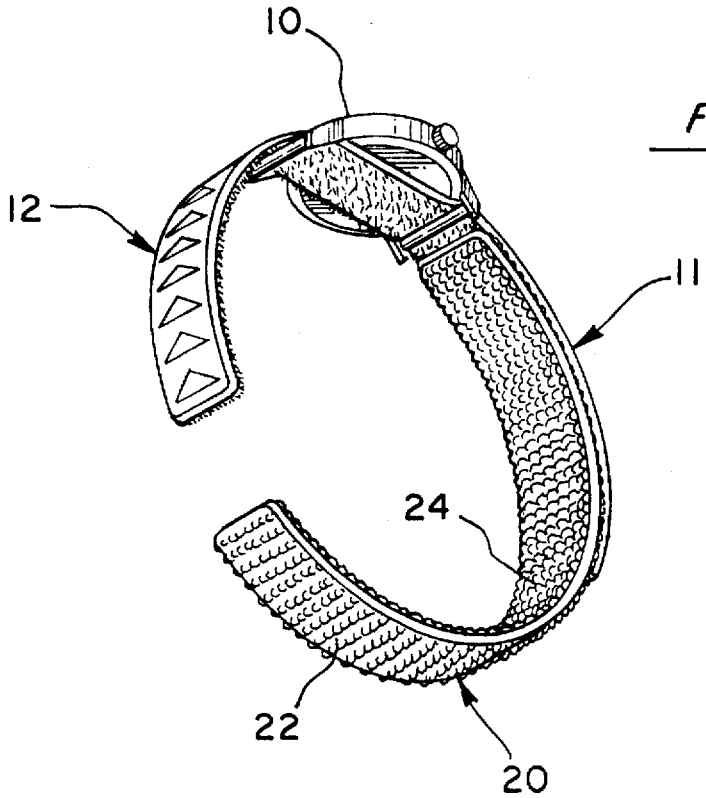
FIG. 2 is al rear perspective view of the watchband assembly and watch with one end of the outer band fastened to the inner band.
Figure 7:
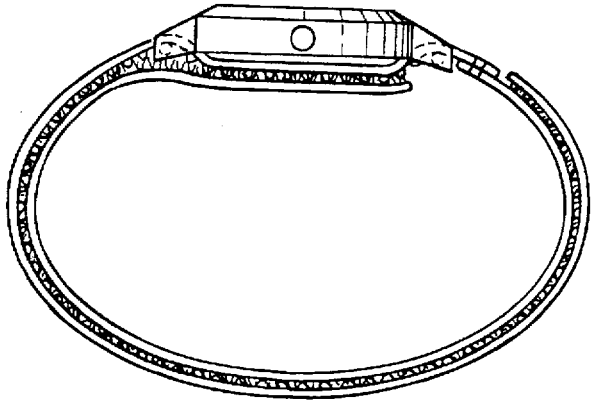
Fig. 7 (Prior Art)
FIG. 7 is a side view of "The Band" watchband corresponding to FIG. 6.

The inner band 20 is a piece of flexible material (e.g., cloth) with complementary hook-and-loop fasteners 22 (e.g., VELCRO) that substantially cover its outer surface. The fasteners 22 on the inner band 20 removably engage the fasteners 43 on the inside surface of said outer band 11, 12 to fasten the watchband around the wearer's wrist. The inner surface 24 of the inner band 20 has a soft texture for comfort when worn against the wearer's skin. The inner band can be furnished with a nylon pile on its inner surface where it contacts the wearer's skin, similar to soft, high-pile carpeting. For example, the pile can have a height of approximately 0.055 inches. Its loose weave allows air to contact the skin. The nylon pile wicks moisture away from the skin to speed evaporation and cooling. The fabric construction of the inner band 20 also allows it to be easily trimmed to a desired length by scissors or a knife. The length of the inner band is normally chosen so that it extends almost completely around the wearer's wrist to maximize the strength of fastener connections between the inner and outer bands. Yet, it is easier to attach and remove than prior art watchbands, such as "THE BAND" or "EK"watchbands. For example, FIG. 2 is a rear perspective view of the watchband assembly with one end 11 of the outer band fastened to the inner band 20. FIG. 3 shows the inner band 20 fastened to both ends 11, 12 of the outer band.

It should be understood that the hook-and-loop fasteners 22, 43 could be placed only on selected regions of the outer surface of the inner band 20 and the inner surface of the outer band. For example, the fasteners 22 could be placed only along the middle portion of the inner band and adjacent to the ends 11, 12 of the outer band to ensure that the ends of the outer band are fastened to the inner band. However, this approach restricts the range of adjustability for the watchband, and reduces the maximum tensile force that the watchband can withstand. Alternatively, a series of fastener patches could be placed along the length of the inner band 20 and/or the outer band.

Also, for decorative purposes, the inner band 20 could be somewhat wider than the outer band 11, 12, although any portion of the inner band 20 protruding from underneath the outer band should not include exposed hook-and-loop fasteners.

After purchasing the watchband and removing it from its packaging, the wearer places the inner band 20 around his wrist to measure the appropriate length for the inner band 20. As previously mentioned, the inner band 20 should extend most of the way around the wearer's wrist to maximize the area of contact between the fasteners on the inner and outer bands, and thereby maximize the gripping strength holding the inner and outer bands together. However, to keep the watch as low-profile as possible, the inner band 20 terminates on each end just before it reaches the round case of the watch 10. In addition, the inner band serves to shield the wrist from the roughness of the VELCRO fasteners on the inside surface of the outer band. The wearer may then trim the inner band 20 to this length with scissors or a knife. Next, the wearer places the outer band 11, 12 around the inner band 20 on his wrist to measure the appropriate length of the outer band 11, 12. The ends of the outer band should abut each other and thereby substantially conceal the inner band when the outer band is fastened around the wearer's wrist, as shown in FIG. 3.

After both bands have been trimmed to appropriate lengths, the wearer can remove the watchband on a day-to-day basis simply by keeping one end of the inner band attached to the corresponding end of the outer band, and detaching the fasteners on the other end of the inner band from its corresponding end of the outer band as shown in FIG. 2. This creates a temporary opening that allows the wearer to easily remove the watchband. Although the inner band 20 and the outer band 11, 12 are completely separable, they need be only partially disengaged to remove the watchband from the wearer's wrist, as shown in FIG. 2.

The wearer can easily put on the watchband by reversing this process. The wearer places his wrist through the opening in the watchband and then aligns the unattached end of the outer band over the exposed outer surface of the inner band 20. The unattached end of the outer band can be fastened to the inner band by applying slight pressure.

If the wearer wants to use a different decorative outer band 11, 12, it is simply disengaged from the inner band 20 as shown in FIG. 1. Another decorative outer band 11, 12 can then be readily attached to the inner band 20.

The watchband is intended primarily for active wear, i.e., to be worn during activities such as bicycling, hiking, running, kayaking, camping, skiing, or rock climbing. This dictates that the watchband must be relatively inexpensive, and yet be capable of withstanding physical abuse. In addition, the watchband should not have protruding pieces that might injure the wearer or become damaged or entangled during physical activity. The watchband should also allow the easy installation and removal of outdoor accessories, e.g., a wrist compass or wrist thermometer. This invention allows easy installation on either side of the watch 10 without removing the watchband from the wrist. The present invention is especially well-suited to meet these requirements. The watchband is made from relatively inexpensive material that can be easily sewn or bonded together. Since both the inner and outer band can be easily trimmed to desired lengths, the watchband can be manufactured in one size, which further reduces manufacturing and inventory costs.

The preceding discussion has assumed that the present invention is used primarily for carrying a watch. It should be expressly understood that the present invention could be used as a wrist band to carry other types of objects, such as a compass or thermometer. The wrist band can also be used as an identification bracelet, or to carry medical information or valuables.

The above disclosure sets forth a number of embodiments of the present invention. Other arrangements or embodiments, not precisely set forth, could be practiced under the teachings of the present invention and as set forth in the following claims.

I claim:

1. A wrist band comprising:

a flexible outer band having an outer surface, an inner surface, and two opposing ends; said outer band having fastener means including a layer of hook-and-loop fastener material substantially covering said inner surface of said outer band; and a flexible inner band having an outer surface with complementary fastener means for removably engaging said fastener means on said inner surface of said outer band to fasten the wrist band.

2. The wrist band of claim 1 wherein said outer band forms a continuous band around a wearer's wrist with said ends abutting each other, thereby substantially concealing said inner band when fastened around the wearer's wrist.

3. The wristband of claim 1 wherein said fastener means of said inner band comprises a layer of hook-and-loop fastener material substantially covering said outer surface of said inner band.

4. The wrist band of claim 1 wherein said outer band further comprises an outer layer of decorative material secured over said fastener material.

5. The wrist band of claim 4 wherein said outer band further comprises a thin flexible plastic strip coated with adhesive between said decorative material and said fastener material.

6. The wrist band of claim 4 wherein said decorative material is sewn to said fastener material.

7. A watchband for carrying a watch and being removably fastened around a wearer's wrist, said watchband comprising:

a cloth outer band having an outer surface, an inner surface, and two opposing ends extending from the watch, said outer band having hook-and-loop fasteners on said inner surface of said outer band; said outer band being trimmable to a desired length to form a continuous band around the wearer's wrist with said ends abutting each other; and a cloth inner band having an outer surface with complementary hook-and-loop fasteners for removably engaging said fasteners on said inside surface of said outer band to fasten said watchband about the wearer's wrist; said inner band being trimmable to a desired length so that said outer band substantially conceals said inner band when fastened around the wearer's wrist.

8. The watchband of claim 7 wherein the hook-and-loop fasteners on said outer band substantially cover said inner surface of said outer band.

9. The watchband of claim 7 wherein the hook-and-loop fasteners on said inner band substantially cover said outer surface of said inner band.

10. The watchband of claim 7 wherein said inner band further comprises an inner surface covered by loosely-woven pile.

11. The watchband of claim 7 wherein said outer band comprises an outer layer of decorative material secured over an inner layer of hook-and-loop fastener material.

12. The watchband of claim 11 wherein said outer band further comprises a thin flexible plastic strip coated with adhesive between said decorative material and said fastener material.

13. The watchband of claim 11 wherein said decorative material is sewn to said fastener material.

14. A watchband for carrying a watch and being removably fastened around a wearer's wrist, said watchband comprising:

a flexible outer band with an outer surface, an inner surface, and two opposing ends extending from the watch; said outer band having:

(a) a layer of decorative material forming said outer surface;

(b) a layer of hook-and-loop fastener material on said inner surface; and (c) a thin flexible plastic strip coated with adhesive bonding said decorative material to said fastener material; and a flexible inner band having an outer surface with complementary hook-and-loop fasteners for removably engaging said fasteners on said inner surface of said outer band to fasten said watchband about the wearer's wrist.

15. The watchband of claim 14 wherein said fastener material on said outer band substantially covers said inner surface of said outer band.

16. The watchband of claim 14 wherein said outer band has opposing edges and wherein said decorative material is sewn to said fastener material along the edges of said outer band.

17. The watchband of claim 14 wherein said inner band further comprises an inner surface covered by loosely-woven pile.

18. The watchband of claim 14 wherein said outer band forms a continuous band around the wearer's wrist with said ends abutting each other, thereby substantially concealing said inner band when fastened around the wearer's wrist.

19. The watchband of claim 14 wherein said fastener material on said inner band substantially covers said outer surface of said inner band.

* * * * *